United States Patent [19]

Hittler

[11] Patent Number: 4,852,687

[45] Date of Patent: Aug. 1, 1989

[54] METHOD AND APPARATUS FOR HAZARDOUS MATERIAL CONTAINMENT AND DISPOSAL

[75] Inventor: Kurt Hittler, Alpharetta, Ga.

[73] Assignee: Grayling Industries, Inc., Alpharetta, Ga.

[21] Appl. No.: 314,882

[22] Filed: Feb. 24, 1989

[51] Int. Cl.[4] ..... E04G 1/26; E04G 21/30

[52] U.S. Cl. ..... 182/129; 182/48

[58] Field of Search ..... 182/129, 48, 49, 137, 182/138, 139, 140

[56] References Cited

U.S. PATENT DOCUMENTS

| | | | |
|---|---|---|---|
| 775,604 | 11/1904 | Kiernan | 182/138 |
| 1,018,698 | 2/1912 | Dennis | 182/138 |
| 1,293,460 | 2/1919 | Johnson et al. | 209/675 |
| 1,334,643 | 3/1920 | Ansley | 182/149 |
| 1,512,792 | 10/1924 | Nelson | 182/129 |
| 2,723,885 | 11/1955 | Dietz | 182/129 |
| 3,995,715 | 12/1976 | Virtanen | 182/129 |
| 4,429,764 | 2/1984 | Park | 182/129 |

*Primary Examiner*—Reinaldo P. Machado
*Attorney, Agent, or Firm*—Thomas & Kennedy

[57] ABSTRACT

A method and apparatus for use in removing hazardous material from overhead structures comprises a work platform supported beneath the structure atop a scaffold. A plastic enclosure extends upwardly and outwardly from the periphery of the platform to define a downwardly tapered upwardly open chamber bounded by the enclosure and the platform. A tubular plastic chute communicates at one end with the interior of the chamber and extends downwardly therefrom to communicate at its other end with a hazardous material receptacle supported on a receptacle support member. Hazardous material removed from overhead structures by a worker on the platform is confined to the chamber by the walls of the enclosure and can be swept by the worker into the chute and directed thereby into the receptacle for disposal.

16 Claims, 1 Drawing Sheet

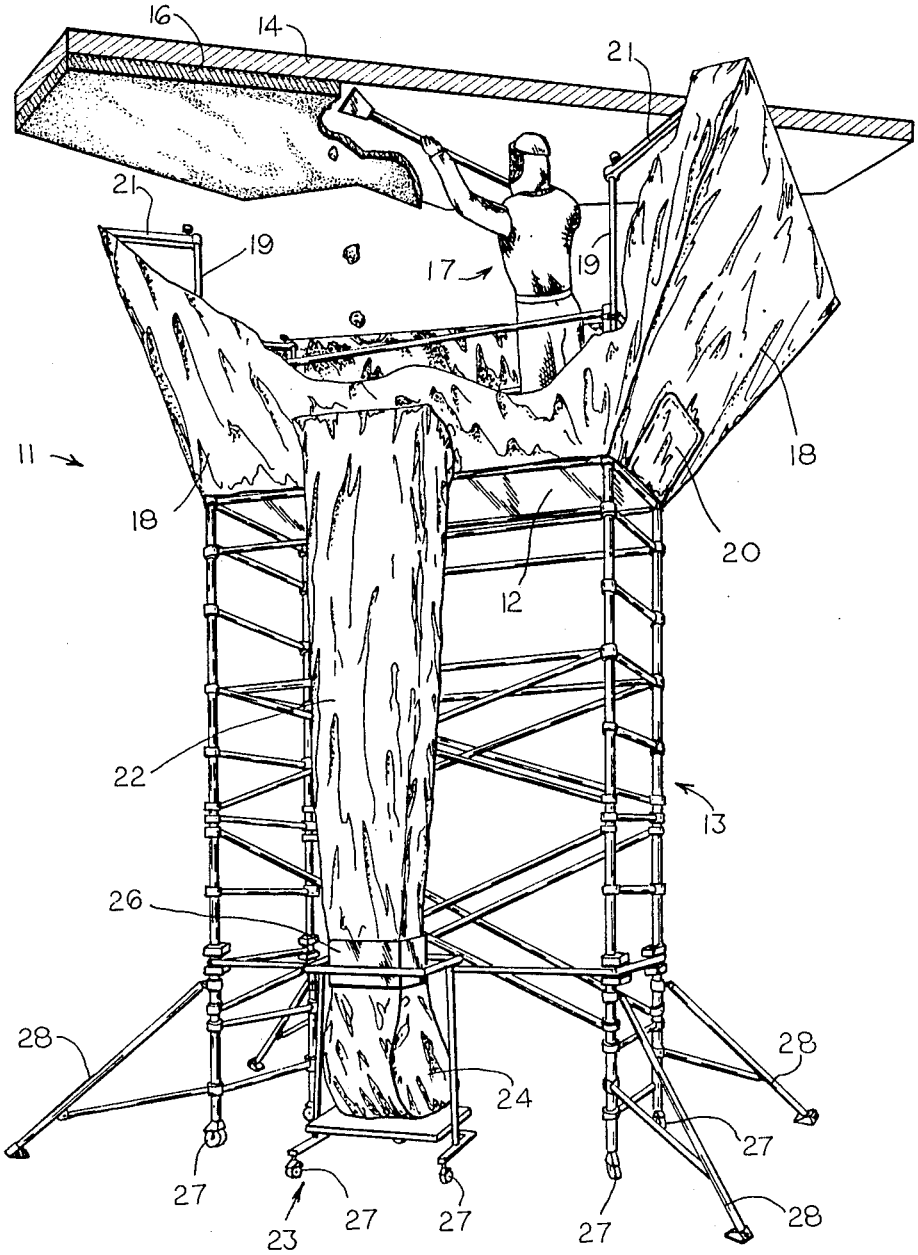
16
14
21
21
19
17
19
11
18
18
20
12
22
13
26
28
28
24
27
27
27
23
27
27
28

METHOD AND APPARATUS FOR HAZARDOUS MATERIAL CONTAINMENT AND DISPOSAL

TECHNICAL FIELD

The present invention relates to removal of asbestos or other hazardous materials, and more particularly, to removal of asbestos insulation from overhead structures.

BACKGROUND OF THE INVENTION

Prior to the discovery that exposure to asbestos, or more particularly, to asbestos fibers or dust, can create significant health hazards, it was common to insulate conduits and other heat transmitting or absorbing structures with asbestos by applying the asbestos to the structures. This was particularly true for overhead structures located adjacent the ceilings of buildings. As a consequence, many older buildings in which asbestos insulation has been used have now been become health hazardous and removal of the asbestos is often required.

Because of the inherent dangers of asbestos exposure, federal and state legislation has been passed which requires extraordinary protection for workers engaged in removal of asbestos containing materials as well as stringent requirements guarding against contamination of buildings in which asbestos is being removed. The interiors of such buildings, for example, are generally completely covered with plastic sheeting prior to the removal process to prevent contact between the building interior surfaces and the removed asbestos. The workers are also required to wear protective gear.

When removing asbestos from overhead structures adjacent the building ceiling, it is common for a worker to erect a scaffold within the building with the scaffold supporting a platform on which the worker can stand as he scrapes and hoses asbestos from the structures. A problem particularly associated with removal of asbestos from overhead structures in this manner is that as the asbestos is removed it tends to fall in pieces and chunks onto the platform and to the floor of the building with the impact of the fall breaking the asbestos into smaller pieces and generating asbestos fibers that become suspended in the air. These small pieces and fibers, in turn, create increased health hazards for workers and other people who may be in the building. Further, clean-up and disposal of asbestos that has fallen to the floor can be a time consuming task that sometimes generates even more suspended asbestos fibers and asbestos particles.

There remains, therefore, a need for a method and apparatus of containing and disposing of asbestos pieces as they are removed from overhead structures within buildings. It is to the provision of such a method and apparatus, therefore, that the present invention is primarly directed.

SUMMARY OF THE INVENTION

The present invention is a method and apparatus for use in removing asbestos or other hazardous material from overhead structures, usually located within a building. The apparatus comprises a work platform supported atop a scaffold that is positionable beneath overhead structures to be cleaned. The scaffold is mounted on wheels such that the scaffold and work platform can be moved from place to place as overhead structures are cleaned of asbestos.

Flexible sheeting extends upwardly and outwardly from the periphery of the platform to define a downwardly tapered open top chamber or trough about the work platform. A chute communicates at one end with the chamber adjacent the platform and extends downwardly to a lower chute end where a guide member may be used to position the lower chute end for communication with a hazardous material receptacle.

In operation, a worker stands on the platform within the chamber formed by the flexible sheeting and removes asbestos from a structure located above the platform. As the asbestos is removed, it typically falls from the structure in chunks and pieces which are confined to the chamber by the upwardly extending sheeting walls. When a significant amount of asbestos has collected on the platform within the chamber, the worker can simply sweep or otherwise move the asbestos into the chute which, in turn, directs the material into a waiting receptacle for disposal.

Thus, a method and apparatus is now provided which addresses extant problems associated with removal of asbestos from overhead structures. Particularly, the invention prevents removed asbestos pieces and chunks from falling to the floor by confining them to the work chamber as they fall. In addition, collected asbestos particles can simply be swept into the chute where they fall harmlessly under the influence of gravity into a receptacle which, when filled, can be sealed and disposed of in the usual way. The result is greatly reduced paticulate counts in the air and quick, easy disposal of removed asbestos.

BRIEF DESCRIPTION OF THE DRAWING

The accompanying drawing figure is a perspective view of an apparatus which embodies principals of the invention in a preferred from. A portion of one of the flexible sheeting chamber walls is shown cut-away to reveal a worker within the chamber removing asbestos from an overhead structure.

DETAILED DESCRIPTION

Referring now in more detail to the drawing, the apparatus 11 comprises a work platform 12 which is supported atop a scaffold 13. The scaffold 13 is constructed and sized to position and support the work platform 12 beneath an overhead ceiling 14 that is covered with asbestos 16 shown being removed by a worker 17 standing on the platform. While the preferred embodiment is illustrated in conjunction with an asbestos covered ceiling, it will be understood that the apparatus can be used for removal of many types of hazardous materials from many types of overhead structures such as heating ducts and ceiling supports.

Extending upwardly and outwardly from the periphery of the platform 12 is an enclosure 18 which defines a downwardly and inwardly tapered open top chamber within which the worker stands to remove asbestos from the pipe. An access door 20 is formed in one side of the enclosure to permit convenient worker ingress and egress from the chamber.

Stanchions 19 are clamped to the four upper corners of the scaffold 13 and extend upwardly therefrom. Rotatably mounted to the top of each stanchion 19 is a support arm 21 adapted to extend outwardly to attach to the corners of the enclosure 18. The enclosure 18 is therefore supported in its erect, downwardly tapered open top configuration by the laterally extending support arms 21.

In the illustrated embodiment, the walls of the enclosure 18 are formed from conjoined sheets of transparent plastic material such as bisquine such that the enclosure is light, compact and easy to handle and erect by a worker. Other materials such as, for example, canvas, could also be used with similar utility.

A chute 22, which preferably is formed of tubular plastic material, is attached at one end to the enclosure 18 and communicates with the chamber defined thereby at a location adjacent the upper surface of the platform 12. The chute 22 extends downwardly from the enclosure 18 to a lower chute end adjacent the bottom portion of the scaffold 13.

A receptacle support member 23 is mounted to the bottom portion of the scaffold 13 and is adapted to support an asbestos receptacle 24 for containing and disposing of asbestos removed by the worker. The receptacle support member 23 includes a guide 26 which may be used to position the lower chute end for communication with a receptacle positioned upon the support member 23. Typically, the lower chute end is inserted through the guide 26 and the mouth of the receptacle 24 is secured about the exterior of the guide. The chute 22, therefore, defines a closed path that communicates between the interior of the enclosure 18 and an asbestos receptacle 24 positioned on the support member 23.

The scaffold 13 and receptacle support member 23 are preferably mounted on a set of wheels or casters 27 such that the apparatus can be moved easily from location to location as asbestos is removed from the overhead pipe 14. Laterally extending support members 28 can be provided if desired to increase the stability of the scaffold as a worker moves about on the platform.

OPERATION

In use, the scaffold 13 and platform 12 are erected in the normal way such that the platform is positioned at a convenient height beneath the overhead structure to be cleaned. The lower portion of the plastic enclosure 18 is then taped or otherwise secured to the upper surface of the platform about its periphery and the stanchions 19 are clamped to the upper corners of the scaffold. The support arms 21 can then be rotated to extend outwardly from the corners of the scaffold as shown and the enclosure 18 raised and attached at its upper corners to the ends of the support arms 21. In this way, the enclosure 18 is held by the support arms in its erected downwardly tapered open top chamber defining configuration as illustrated in the drawing.

The receptacle support member 23 can then be mounted to the bottom of the scaffold and a receptacle 24 positioned thereon with the mouth of the receptacle secured about the guide 26. The chute 22 is then unfurled and the lower chute end inserted through the guide 26 and into the receptacle 24 such that the chute communicates between the interior of the chamber and the receptacle.

With the apparatus thus erected, a worker climbs the scaffold and enters the chamber through the access door 20, stands upon the platform within the chamber and begins to remove asbestos from the pipe. As asbestos is removed, it falls from the pipe in chunks and pieces which are confined to the chamber by the walls of the enclosure 18. The removed and confined asbestos pieces tend to collect on the upper surface of the platform. Upon accumulation of a predetermined amount of asbestos on the platform, the worker can simply sweep or otherwise move the asbestos pieces into the mouth of the chute 22 from where they gravitate into the asbestos receptacle 24. When the receptacle 24 has been filled with asbestos, the plastic chute 22 can be pinched or otherwise closed off and the receptacle 24 removed, sealed and discarded in a safe manner whereupon a fresh receptacle can be position on the support member 23 and the asbestos removal operation continued. In continuing the cleaning operation the scaffold may be rolled to new position on the floor where the enclosure overlaps the cleaned areas of the overhead structures. As this is done the edge boundary of the end of the hazardous material is is maintained over the enclosure. In this manner the structure may be fully cleaned of the hazardous material without any of it falling outside of the enclosure and without having to sleeve and tie off the exposed end of the material.

It thus is seen that an apparatus and method is now provided for use in containing and disposing of hazardous materials as they are removed from overhead structures. Although the invention has been described in terms of a preferred embodiment, it should be understood that many additions, deletions and modifications may be made thereto without departing from the spirit and scope of the invention a set forth in the following claims.

I claim:

1. Apparatus for use in removing hazardous materials such as asbestos from overhead structures, said apparatus comprising:

platform means for supporting a worker;

scaffold means for supporting said platform means upon and elevated above a floor beneath overhead structures from which hazardous material is to be removed; and enclosure means mounted atop said scaffold means about said platform means, said enclosure means and platform means at least partialy defining an open top work chamber in which hazardous materials may be removed and collected from overhead structures.

2. The apparatus of claim 1 further comprising a chute communicating at an upper end with said work chamber and which extends downwardly therefrom to a lower chute end.

3. The apparatus of claim 2 further comprising receptacle support means for supporting a hazardous material receptacle mounted to said lower chute end.

4. The apparatus of claim 3 comprising a first set of wheels mounted to said receptacle support means and a second set of wheels mounted to said scaffold means.

5. The apparatus of claim 1 wherein said chute communicates with the interior of said chamber at a location closely adjacent the periphery of said platform whereby lose hazardous material may be swept from the platform into the chute.

6. The apparatus of claim 1 wherein said enclosure means extends upwardly and outwardly from adjacent the periphery of said platform means to define a downwardly tapered open top work chamber whereby cutaway hazardous material may be funneled by the enclosure to collect upon the platform.

7. The apparatus of claim 6 wherein said enclosure means is formed of plastic sheeting.

8. The apparatus of claim 6 further comprising access door means formed in said plastic sheeting for ingress and egress of workers to and from said work chamber.

9. A method of removing and collecting hazardous material from a structure elevated above a floor without substantial quantities of the material falling upon the floor and wherein the method comprising the steps of:

(a) positioning an enclosed, open top work station borne by a scaffold beneath a first portion of the structure within working reach of the structure;

(b) manually removing and collecting material from the first structure portion;

(c) moving the scaffold on the floor so as to position the work station beneath a second portion of the structure that overlaps the first portion, and (d) manually removing and collecting material from the second structure portion.

10. The method of claim 9 wherein steps (b) and (d) the material is collected in the work station.

11. The method of claim 10 wherein periodically the collected material is deposited into the upper end of a chute and gravitated into a collection bag that is removably secured to the lower end of the chute.

12. In a scaffold of the type that supports a work platform adjacent overhead structures from which hazardous material is to be removed, the improvement comprising:

enclosure means defining an open top chamber bounded at least partially by said enclosure means and the platform;

a chute communicating at one end with the interior of said chamber and extending downwardly therefrom to a lower chute end;

receptacle support means for supporting a hazardous material receptacle below the platform; and guide means for positioning the lower chute end for communication with a receptacle positioned on said receptacle support means, whereby hazardous material removed from overhead structures by a worker standing upon the platform is confined to the chamber by the enclosure means from which chamber it may be moved into the chute and deposited into a receptacle secured to the lower chute end for disposal.

13. The improvement of claim 12 wherein said enclosure means extends upwardly and outwardly from the periphery of the platform to define a downwardly tapered open top chamber.

14. The improvement of claim 13 wherein said enclosure means is formed of plastic sheeting.

15. The improvement of claim 12 wherein said chute communicates with the interior of said chamber at a location beside the platform.

16. The improvement of claim 15 wherein said chute is formed of tubular plastic sheeting.

* * * * *